US010354638B2

(12) United States Patent
Krasnov et al.

(10) Patent No.: US 10,354,638 B2
(45) Date of Patent: Jul. 16, 2019

(54) ACOUSTIC WALL ASSEMBLY HAVING ACTIVE NOISE-DISRUPTIVE PROPERTIES, AND/OR METHOD OF MAKING AND/OR USING THE SAME

(71) Applicant: Guardian Glass, LLC, Auburn Hills, MI (US)

(72) Inventors: Alexey Krasnov, Canton, MI (US); Barry B. Corden, Auburn Hills, MI (US); Ed Green, Auburn Hills, MI (US)

(73) Assignee: Guardian Glass, LLC, Auburn Hills, MI (US)

( * ) Notice: Subject to any disclaimer, the term of this patent is extended or adjusted under 35 U.S.C. 154(b) by 35 days.

(21) Appl. No.: 15/057,867

(22) Filed: Mar. 1, 2016

(65) Prior Publication Data

US 2017/0256250 A1 Sep. 7, 2017

(51) Int. Cl.
*E04B 1/84* (2006.01)
*E04B 1/99* (2006.01)
(Continued)

(52) U.S. Cl.
CPC ..... *G10K 11/178* (2013.01); *E04B 1/84* (2013.01); *G10K 11/175* (2013.01);
(Continued)

(58) Field of Classification Search
CPC ..... G10K 11/175; G10K 2210/3224; G10K 2210/3219; G10K 2210/12;
(Continued)

(56) References Cited

U.S. PATENT DOCUMENTS 1,483,365 A 2/1824 Mazer
2,132,642 A 10/1938 Parsons
(Continued)

FOREIGN PATENT DOCUMENTS

DE 33335210 4/1985
DE 10 2014 111 365 2/2016
(Continued)

OTHER PUBLICATIONS

Vorlander, Matreial Data the basic parameters of acoustic material, 2007.*

(Continued)

*Primary Examiner* — Davetta W Goins
*Assistant Examiner* — Kuassi A Ganmavo

(57) ABSTRACT

Certain example embodiments relate to an acoustic wall assembly that uses active and/or passive sound reverberation to achieve noise-disruptive functionality, and/or a method of making and/or using the same. With the active approach, sound waves in a given frequency range are detected by a sound masking circuit. Responsive to detection of such sound waves, an air pump (e.g., speaker) is used to pump air in the wall assembly to actively mask the detected sound waves via reverberation and/or the like. The wall assembly may include one, two, or more walls, and the walls may be partial or full walls. With the passive approach, sound waves in a given frequency range are disrupted via features (e.g., holes, slits, etc.) formed in and/or on a wall itself. These techniques may be used together or separately, in different example embodiments.

6 Claims, 12 Drawing Sheets

(51) Int. Cl.
*G10K 11/175* (2006.01)
*G10K 11/178* (2006.01)

(52) U.S. Cl.
CPC ..... *G10K 11/17861* (2018.01); *E04B 1/99* (2013.01); *G10K 2210/12* (2013.01); *G10K 2210/3012* (2013.01); *G10K 2210/3045* (2013.01); *G10K 2210/3212* (2013.01); *G10K 2210/3223* (2013.01); *G10K 2210/3227* (2013.01)

(58) Field of Classification Search
CPC .... G10K 11/1788; H04R 9/045; H04R 5/027; H04R 2499/15; H04R 2499/13; H04R 7/06; H04R 2307/029; E01F 8/007; E01F 8/0011
See application file for complete search history.

(56) References Cited

U.S. PATENT DOCUMENTS 2,159,488 A 5/1939 Parkinson
2,966,954 A 1/1961 Sabine
3,239,973 A 3/1966 Hannes et al.
3,384,199 A 5/1968 Eckel
3,621,934 A * 11/1971 Thrasher ..... E04B 1/8409 181/290
3,879,578 A 4/1975 Wildi
4,059,726 A * 11/1977 Watters ..... H04K 1/02 380/252
4,098,370 A * 7/1978 McGregor ..... G10K 11/175 181/150
4,099,027 A 7/1978 Whitten
4,195,202 A 3/1980 McCalmont
4,268,717 A 5/1981 Moore
4,476,572 A 10/1984 Horrall et al.
5,024,288 A * 6/1991 Shepherd ..... B64C 1/40 181/206
5,202,174 A 4/1993 Capaul
5,368,917 A 11/1994 Rehfeld et al.
5,438,624 A * 8/1995 Lewiner ..... G10K 11/1788 381/71.12
5,491,310 A 2/1996 Jen
5,627,897 A 5/1997 Gagliardini et al.
5,668,744 A 9/1997 Varadan et al.
5,724,432 A * 3/1998 Bouvet ..... G10K 11/1786 381/71.1
5,754,662 A * 5/1998 Jolly ..... G10K 11/1786 381/71.11
5,997,985 A 12/1999 Clarke
6,078,673 A * 6/2000 von Flotow ..... G10K 11/1788 381/71.4
6,119,807 A 9/2000 Benson, Jr. et al.
6,483,926 B1 * 11/2002 Yamashita ..... G10K 11/1788 381/71.14
6,771,791 B2 8/2004 Shelley
7,194,094 B2 3/2007 Horrall
7,363,227 B2 * 4/2008 Mapes-Riordan ..... G10L 21/06 704/273
7,754,338 B2 7/2010 Anderson
7,756,281 B2 7/2010 Goldstein
7,761,291 B2 7/2010 Renevey et al.
7,763,334 B2 7/2010 Berkowitz
7,854,295 B2 12/2010 Kakuhari
8,100,225 B2 1/2012 Bartha
8,180,067 B2 5/2012 Soulodre
8,739,927 B2 6/2014 Kang
8,925,678 B2 1/2015 Tizzoni
9,186,865 B2 11/2015 Blanchard et al.
9,390,702 B2 7/2016 Mathur
9,980,041 B2 5/2018 Kawakami et al.
2002/0017426 A1 2/2002 Takahashi et al.
2003/0048910 A1 * 3/2003 Roy ..... F24F 13/06 381/73.1
2003/0091199 A1 5/2003 Horrall
2003/0215108 A1 11/2003 Shelley
2004/0057584 A1 3/2004 Kakuhari et al.
2004/0102975 A1 5/2004 Eide
2004/0125922 A1 7/2004 Specht
2004/0189475 A1 9/2004 Cooper
2004/0191474 A1 9/2004 Yamagiwa
2005/0065778 A1 3/2005 Mastrianni et al.
2005/0157891 A1 7/2005 Johansen
2006/0009969 A1 * 1/2006 L'Esperance ..... G10K 11/175 704/226
2006/0109983 A1 * 5/2006 Young ..... H04K 3/43 380/252
2006/0147051 A1 7/2006 Smith
2006/0289229 A1 12/2006 Yamaguchi
2008/0002833 A1 1/2008 Kuster
2008/0187147 A1 * 8/2008 Berner ..... F24F 13/24 381/71.3
2008/0235008 A1 * 9/2008 Ito ..... G10K 11/175 704/216
2009/0084627 A1 4/2009 Tsugihashi
2010/0014683 A1 1/2010 Maeda
2010/0028134 A1 2/2010 Slapak
2010/0175949 A1 7/2010 Yamaguchi
2010/0266138 A1 * 10/2010 Sachau ..... H04S 3/00 381/73.1
2011/0182438 A1 * 7/2011 Koike ..... G10L 21/04 381/73.1
2011/0274283 A1 * 11/2011 Athanas ..... G10K 11/1782 381/71.7
2012/0197641 A1 8/2012 Akechi et al.
2012/0240486 A1 * 9/2012 Borroni ..... B32B 3/266 52/145
2012/0247867 A1 10/2012 Yang
2012/0316869 A1 12/2012 Xiang
2013/0016847 A1 1/2013 Steiner
2013/0028443 A1 1/2013 Pance
2013/0163772 A1 * 6/2013 Kobayashi ..... G10K 11/175 381/71.1
2013/0182866 A1 7/2013 Kobayashi
2013/0185061 A1 7/2013 Arvanaghi
2013/0259254 A1 10/2013 Xiang
2013/0315413 A1 * 11/2013 Yamakawa ..... G10K 11/175 381/73.1
2013/0332157 A1 12/2013 Lyengar et al.
2014/0153744 A1 6/2014 Brannmark
2014/0200887 A1 7/2014 Nakadai
2015/0055790 A1 * 2/2015 Kawakami ..... G10K 11/178 381/73.1
2015/0065788 A1 3/2015 Rapoport
2015/0104026 A1 4/2015 Kappus et al.
2015/0139435 A1 * 5/2015 Forrest ..... H04K 3/825 381/73.1
2015/0245137 A1 8/2015 Sugano
2015/0341722 A1 11/2015 Iyengar
2015/0348530 A1 * 12/2015 Findlay ..... G10K 11/1786 381/309
2016/0269828 A1 9/2016 Smith et al.
2016/0365079 A1 12/2016 Scherrer
2016/0381453 A1 12/2016 Ushakov
2017/0256250 A1 9/2017 Krasnov
2017/0360347 A1 12/2017 Bowles
2018/0039478 A1 2/2018 Sung
2018/0040338 A1 2/2018 Schiro
2018/0047126 A1 2/2018 Falkenstern
2018/0233161 A1 8/2018 Kagoshima

FOREIGN PATENT DOCUMENTS

DE 10 2014 111365 2/2016
DE 102014111365 2/2016
JP H05 181488 7/1993
JP H08 144390 6/1996
JP 2011-123141 6/2011
WO WO2000047012 A2 * 8/2000 ..... G10K 15/04
WO 2009/156928 12/2009

(56) References Cited

FOREIGN PATENT DOCUMENTS

| | | | |
|---|---|---|---|
| WO | WO 2012007746 A2 * | 1/2012 | ..... G01H 7/00 |
| WO | WO 2016116330 A1 * | 7/2016 | ..... G10K 11/175 |

OTHER PUBLICATIONS

Wenger, Acoustic probem solution, 2000.*
HermanMiller, Sound Masking in the Office,2003.*
Arai et al, Effects of suppressing steady state portions of speech on intelligibility in reverberant environments, AST, 2002.*
Wikipedia—Sound Masking, retrieved Mar. 2, 2016, 36 pages. https://en.wikipedia.org/wiki/Sound_masking.
U.S. Appl. No. 15/057,890, filed Mar. 1, 2016, Krasnov et al.
U.S. Appl. No. 15/057,842, filed Mar. 1, 2016, Krasnov et al.
Forrest et al., "Effects of white noise masking and low pass filtering on speech kinematics," J. Speech Hear. Res. 29, Dec. 1986, pp. 549-562.
Simon Arnfield, "Emotional stress and speech tempo variability." Proc. ESCA/NATO Workshop on Speech Under Stress, Lisbon, Portugal, Sep. 14-15, 1995, 3 pages. http://www.isca-speech.org/archive_open/archive_papers/sus_95/sus5_013.pdf.
Richard M. Warren, "Perceptual Restoration of Missing Speech Sounds," Science, New Series, vol. 167, No. 3917, Jan. 23, 1970, 3 pages. http://web.cse.ohio-state.edu/~dwang/teaching/cse788/papers/Warren70.pdf.
Makio Kashino, "Phonemic Restoration: The Brain Creates Missing Speech Sounds," Acoustical Science and Technology, Jan. 2006, 5 pages. https://www.researchgate.net/publication/252169039_Phonemic_restoration_The_brain_creates_missing_speech_sounds.
R. Carhart et al., "Perceptual Masking of Spondees by Combinations of Talkers," The Journal of Acoustical Society of America, 1975, 2 pages. http://asa.scitation.org/doi/pdf/10.1121/1.2002082.
Yi Hu et al., "Effects of Early and Late Reflections on Intelligibility of Reverberated Speech by Cochlear Implant Listeners," Jan. 2014, 7 pages. https://www.ncbi.nlm.nih.gov/pmc/articles/PMC3874051/.
Michael Rugg et al., "How Does Background Noise Affect our Concentration?" Jan. 2010, 7 pages. https://www.scientificamerican.com/article/ask-the-brains-background-noise/#.
Adelbert W. Bronkhorst, "The Cocktail Party Phenomenon: A Review of Research on Speech Intelligibility in Multiple-Talker Conditions," Acta Acustica United with Acustica, vol. 86, Jan. 2000, 13 pages. https://www.researchgate.net/publication/230739432_The_Cocktail_Party_Phenomenon_A_Review_of_Research_on_Speech_Intelligibility_in_Multiple-Talker_Conditions.
Jungsoo Kim et al., "Workspace Satisfaction: The Privacy-Communication Trade-off in Open-Plan Offices," Journal of Environmental Psychology. UC Berkeley: Center for the Built Environment, Jun. 2013, 22 pages. http://escholarship.org/uc/item/2gq017pb.
Manna Navai et al., "Acoustic Satisfaction in Open-Plan Offices: Review and Recommendation," National Research Council Canada, Institute for Research in Construction, IRC-RR-151, Jul. 17, 2003, 24 pages. https://www.researchgate.net/publication/44063658_Acoustic_Satisfaction_in_Open-Plan_Offices_Review_and_Recommendations.
U.S. Appl. No. 15/459,220, filed Mar. 15, 2016, Krasnov.
U.S. Appl. No. 15/459,273, filed Mar. 15, 2016, Krasnov.
U.S. Appl. No. 15/459,307, filed Mar. 15, 2016, Krasnov.
U.S. Appl. No. 15/459,352, filed Mar. 15, 2016, Krasnov.
Moeller, Retrofitting Sound Masking Improving Speech Privacy and Noise Control in Occupied Spaces, Feb. 2014, 4 pages.
Bao et al, Active Acoustic Control of Noise Transmission Through Double Walls Effects of Mechanical Paths, JSV, Feb. 1998, 4 pages.
Kaiser, Active Control of Sound Transmission through a Double Wall Structure, 2001, 249 pages.
Taylor et al, Sound Masking Systems, Atlas Sound, 2000, 56 pages.
Boothroyd, A., Mulhearn, B., Gong, J., and Ostroff, J., "Effects of spectral smearing on phoneme and word recognition," J. Acoust. Soc. Am. 100, Sep. 1996, 1807-1818.
Childers, D.G. and Wu, K., "Gender recognition from speech. Part II: Fine Analysis," J. Acoust. Soc. Am. 90, Oct. 1991, 1841-1856.
DeLoach, A., "Tuning the cognitive environment: Sound masking with "natural" sounds in open-plan offices," J. Acoust. Soc. Am. 137, Apr. 2015, 2291-2293.
Festen, J.M., "Effects of fluctuating noise and interfering speech on the speech-reception threshold for impared and normal hearing," J. Acoust. Soc. Am. 88, Oct. 1990, 1725-1736.
Festen, J.M., "Contributions of comodulation masking release and temporal resolution to the speech-reception threshold masked by an interfering voice," J. Acoust. Soc. Am. 94, Sep. 1993, 1295-1300.
Plomp, R., "Auditory handicap of hearing impairment and the limited benefit of hearing aids," J. Acoust. Soc. Am. 63, Feb. 1978, 533-549.
Rosen, S. and Fourcin, A., "Frequency Selective and the Perception of Speech," *Frequency Selectivity of Hearing*, edited by B.C.J. Moore (AP London), (1986), pp. 373-487.
Simpson, A., "Phonetic differences between male and female speech," *Language and Linguistics Compass* 3/2, Mar. 2009, 621-640.
Ter Keurs, M., Festen, J.M., and Plomp, R., "Effect of spectral envelope smearing on speech reception. I," J. Acoust. Soc. Am. 91, May 1992, 2872-2880.
PCT International Search Report for PCT/US2017/018836 dated May 15, 2017.
UCSC, "Room Modes," May 2, 2016, 4 pages.
Bolt, Theory of speech masking by reverberation, JASA, Jun. 2005, 2 pages.
Noxon, Coherent and Incoherent Diffusion, Sep. 1990, 10 pages.
Wilson, Rhonda J. "The Loudspeaker—Room Interface—Controlling Excitation of Room Modes", AES Conference May 23, 2003 pp. 1-14.
Ndo, G. et al., "An Hybrid Approach of Low Frequency Room Equalization: Notch Filters based on Common Acoustical Pole Modeling", 2007 15th EP Signal Processing Sep. 3, 2007, pp. 1600-1604.
Assmann ("The perception of Speech under Adverse Conditions", p. 231-308. https://pdfs.semanticscholar.org/f9e9/75030e84f2181b92cacl656f5f796f3c0c3e.pdf).
Green et al.; "A Method of Enhancing Speech Privacy", NOISE-CON; Jun. 12-14, 2017; pp. 479-482.

* cited by examiner

ACOUSTIC WALL ASSEMBLY HAVING ACTIVE NOISE-DISRUPTIVE PROPERTIES, AND/OR METHOD OF MAKING AND/OR USING THE SAME

FIELD OF THE INVENTION

Certain example embodiments of this invention relate to an acoustic wall assembly having noise-disruptive properties, and/or a method of making and/or using the same. More particularly, certain example embodiments of this invention relate to an acoustic wall assembly that uses active and/or passive sound reverberation to achieve noise-disruptive functionality, and/or a method of making and/or using the same.

BACKGROUND AND SUMMARY OF EXAMPLE EMBODIMENTS OF THE INVENTION

Irritating noises, including outside speech, oftentimes is problematic in a wide range of settings including, for example, offices, homes, libraries, and/or the like. Interestingly, people tend to tolerate the noises that they themselves make, even though they sometimes are unaware of the trouble that they are making for others.

In fact, there are many known potential adverse effects elicited by enduring annoying sounds. These adverse effects can range from productivity losses for organizations (e.g., for failure to maintain and/or interruptions in concentration) to medical issues for people (e.g., the onset of headaches caused by annoying sounds, irritability, increased heart rate, and/or the like) and to even the urge to seek a new work environment. Misophonia, a learned condition relating to the association of sound with something unpleasant, also happens from time-to-time. Some people suffer from acoustic hyper-vigilance or oversensitivity to certain sounds.

In many settings, sound annoyance oftentimes is related to loudness, abruptness, high pitch and, in case of speech sounds, the speech content. In many cases, there are certain components in speech or noise that make them particularly disruptive or irritating. With respect to speech content, humans tend to strain to hear what is said, which has been found to subconsciously add to the annoyance. That is, once one is aware of somebody speaking, one oftentimes becomes involuntarily involved, adding a sort of subconscious annoyance.

People oftentimes are irritated by high frequencies (e.g., sounds in the 2,000-4,000 Hz range). These sounds do not need to be of high intensity to be perceived to be loud. In this regard, FIG. 1 is a graph showing perceived human hearing at a constant level, plotting sound pressure level against frequency. As can be seen, the "equal loudness sound curve" in FIG. 1 demonstrates that lower-frequency sounds with high sound pressure levels generally are perceived the same way that higher-frequency sounds with lower sound pressure levels are perceived. Typically, irritation increases with volume of the noise.

Sound waves propagate primarily in a longitudinal way, by alternating compressions and rarefactions of air. When the waves hit a wall, the distortion of molecules creates pressure on the outside of the wall that, in turn, emanates secondary sound.

It will be appreciated that it would be desirable to design a wall with noise-cancellation properties. Generally, the more porous a material is and the greater its thickness, the more soundproof it is. Glass is a good sound reflector but unfortunately is not a good sound insulator. Thus, it will be appreciated that it would be desirable to design a transparent wall with noise-cancellation properties.

Sound-insulating windows have been known in the art. One mainstream approach involves increasing the Sound Transmission Class (STC) of the wall. STC is an integer rating of how well a wall attenuates sound. It is weighted over 16 frequencies across the range of human hearing. STC can be increased by, for example, using of certain geometry of double-pane glass walls in order to destructively resonate sound; increasing the STC of single- or double-pane walls by increasing thickness of the glass, and/or using laminated glass.

Unfortunately, however, these techniques come at a cost. For example, increasing the thickness of single-pane glass allows only modest sound abatement, while adding to the cost. The use of double-pane glass, albeit more effective, typically requires the use of at least two comparatively thick (e.g., 6-12.5 mm) glass sheets. These approaches also typically require high tolerances in the wall construction, and the use of special pliant mechanical connections in order to avoid flanking effects. Glass of such thickness is heavy and expensive, and results in a high installation cost.

Furthermore, double-pane walls typically work well primarily for low-frequency sounds. This can limit their effectiveness to a smaller number of applications such as, for example, to exterior walls to counteract the low-frequency noise of jet and car engines, noise of seaports, railways, etc. At the same time, most speech sounds responsible for both annoyance and speech recognition lye within the 1800-2400 Hz range. It therefore would be desirable to achieve noise cancellation in this higher-frequency range, e.g., in order to help block irritating components and increase speech privacy.

Instead of abating higher-frequency noise, some solutions focus on sound masking. For instance, sounds of various frequencies may be electronically overlapped through a speaker, so that the extra sound is provided "on top of" the original noise. This approach obscures the irritation, but it unfortunately also creates additional noise, which some people perceive as irritating in itself.

Still another approach for achieving noise cancellation is used in Bose headphones, for example. This approach involves registering incoming noise and creating a counteracting noise that is out of phase with the registered incoming noise. One difficulty of this concept for walls, however, is that it typically only works well on a small area and it suitable primarily for continuous sounds (such as, for example, the hum of engines).

Thus, it will be appreciated that it would be desirable to provide for techniques that overcome some or all of the above-described and/or other problems. For example, it will be appreciated that it would be desirable to provide acoustic walls that help reduce or otherwise compensate for sounds that cause irritation and annoyance to users.

One aspect of certain example embodiments relates to an acoustic wall assembly that helps overcome some or all of the above-described and/or other problems.

Another aspect of certain example embodiments relates to an optically transparent interior glass wall assembly with a low STC.

Yet another aspect of certain example embodiments relates to improving the acoustics of rooms formed by and/or contained within the example wall assemblies disclosed herein. Acoustics of the room advantageously can be improved by, for example, increasing speech privacy, obscuring irritating outside noises otherwise perceivable in the room, providing counter-surveillance properties, and/or the like.

In certain example embodiments, an acoustic wall assembly is provided. A wall has an outside major surface and an inside major surface. An air pump is provided. A sound masking circuit is configured to: detect sound waves in a predetermined frequency range; and responsive to detection of sound waves in the predetermined frequency range, control the air pump to pump air to actively mask the detected sound waves as they pass from outside the outside major surface of the wall to inside the inside major surface of the wall.

In certain example embodiments, an acoustic wall assembly is provided. A wall has an outside major surface and an inside major surface. A receiver is sensitive to sound. A pump is controllable to generate pressure waves. A control circuit is operably coupled to the receiver and the pump, with the control circuit being configured to process a signal received from the receiver and control the pump to selectively generate pressure waves to disrupt, via a reverberative effect, noise in a predetermined frequency range that otherwise would pass through the wall.

In certain example embodiments, a kit for retrofitting a wall to provide an acoustic wall assembly with noise masking properties is provided. The kit comprises a receiver sensitive to sound; a pump controllable to generate pressure waves in and/or on the acoustic wall assembly; and a control circuit operably connectable to the receiver and the pump, with the control circuit being configured to process a signal received from the receiver and control the pump to selectively generate pressure waves to disrupt, via a reverberative effect, noise in a predetermined frequency range that otherwise would pass through the wall.

In certain example embodiments, a method of disrupting noise is provided. A wall includes an outside major surface and an inside major surface. Sound waves in a predetermined frequency range are detected via a sound masking circuit. Responsive to detection of sound waves in the predetermined frequency range, an air pump is controlled via the sound masking circuit to pump air in and/or around the wall to actively mask the detected sound waves as they pass from outside the outside major surface of the wall to inside the inside major surface of the wall.

In certain example embodiments, a method of making a sound-masking wall assembly that includes a wall is provided. A receiver sensitive to sound is provided. A pump controllable to generate pressure waves for the sound-masking wall assembly is provided. A control circuit is operably coupled to the receiver and the pump, with the control circuit being configured to process a signal received from the receiver and control the pump to selectively generate pressure waves to disrupt, via a reverberative effect, noise in a predetermined frequency range that otherwise would pass through the wall.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
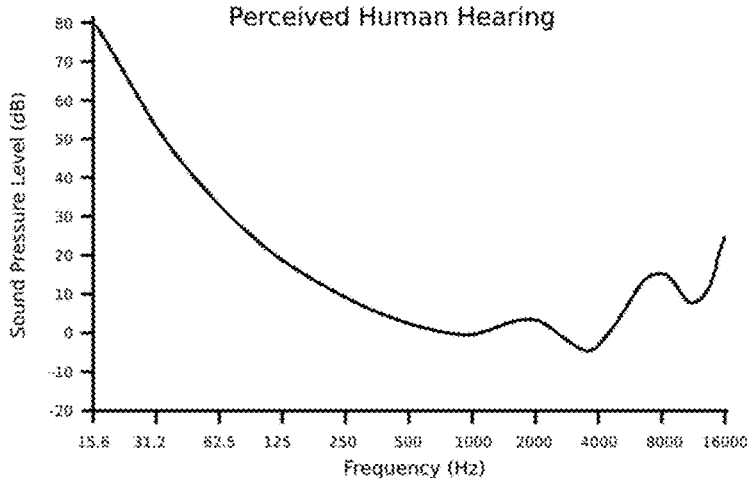
FIG. 1 is a graph showing perceived human hearing at a constant level, plotting sound pressure level against frequency.

Certain example embodiments relate to an acoustic wall assembly that uses active and/or passive sound reverberation to achieve noise-disruptive functionality, and/or a method of making and/or using the same. Reverberation, added in an active and/or passive manner, helps to mask irritating sounds that originate from outside of a room equipped with such a wall assembly and/or from beyond such a wall assembly. This approach includes, for example, helping to make speech taking place outside of the room and/or beyond the wall assembly to be perceived as unintelligible, in certain example embodiments.

Certain example embodiments add noise-cancelling and speech-disruptive properties to walls with a low STC, advantageously allowing for low-cost, low-weight solutions with speech-privacy qualities. Certain example embodiments may be used in high-STC walls, e.g., as a measure to further improve speech privacy and/or noise cancellation.

Reverberation sometimes is advantageous when compared to common sound-abating and masking techniques. For example, reverberation in some instances adds only the loudness necessary to disrupt speech or noise. No unnecessary additional noise is created in some embodiments. Reverberation also advantageously is not restricted to specific wall assembly dimensions and/or geometries, can work equally well at low and high frequencies, and is forgoing with respect to the presence of flanking losses (which otherwise sometimes undermine sound isolation as a result of sound vibrations passing through a structure along an incident path such as, for example, through framing connections, electrical outlets, recessed lights, plumbing pipes, ductwork, etc.). Reverberation also advantageously is resistant to surveillance. Speech masked by white noise sometimes can be easy to decipher (e.g., by removing the additional noise from the signal), reverberation is difficult to decode because there basically is no reference signal (e.g., it is basically self-referenced). Furthermore, reverberation in at least some instances can be activated as-needed, and its volume can be controlled. An additional benefit of using reverberation relates to its ability to disrupt so-called "beating," which is a potentially irritating infra-sound constructed by two different sound frequencies. Although infra-sound cannot be heard per se, it has an adverse subconscious effect. Still further, reverberation may be advantageous from a cost perspective, because it merely disrupts sound rather than trying to eliminate it completely or cover over it. Indeed, reverberation oftentimes will require less energy than the addition of white noise.

When it comes to speech in particular, certain example embodiments are effective in There are following areas of interest in disrupting the speech: disrupting fundamental frequencies of speech and their harmonics; masking key acoustic cues of overlapping syllables and vowels; eliminating artificially created infra-sound with sub-threshold frequencies that resonate adversely with the brain waves (e.g., in the 4-60 Hz range, with the envelope fluctuation of speech coincidentally having a maximum at about 4 Hz, which corresponds to the number of syllables pronounced per second); providing sound disruption in frequency domain by adding frequencies; providing sound disruption in time domain using reverberation; and/or the like.

Figure 2:
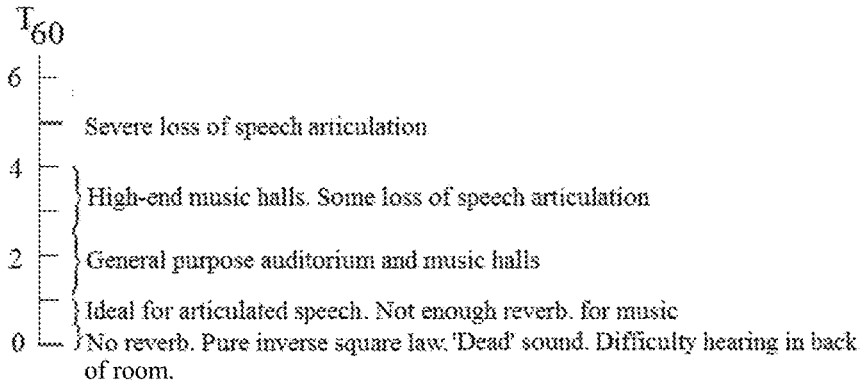
FIG. 2 is a diagram with some examples of what happens with different reverberation times, and showing example applications suitable for different reverberation times.

Reverberation time, $T_{60}$, is one measure associated with reverberation. It represents the time required for sound to decay 60 decibels from its initial level. Rooms with different purposes benefit from different reverberation times. FIG. 2 is a diagram with some examples of what happens with different reverberation times, and showing example applications suitable for different reverberation times. In general, values of $T_{60}$ that are too low (e.g., little to no reverberation) tend to make speech sound "dead," whereas values of $T_{60}$ that are too high (e.g., providing a lot of reverberation) tend to make speech unintelligible. Also in general, optimal reverberation times make speech and music sound rich.

$T_{60}$ can be calculated based on the Sabine formula:

$$T_{60} = 0.16\frac{V}{S_e}$$

In this formula, V is the volume and $S_e$ is a combined effective surface area of the room. The $S_e$ of each wall is calculated by multiplying the physical area by the absorption coefficient, which is a textbook value that varies for different materials. The following table provides the sound absorption coefficients of some common interior building materials.

| | 125 Hz | 250 Hz | 500 Hz | 1 kHz | 2 kHz | 4 kHz |
|---|---|---|---|---|---|---|
| Floor Materials | | | | | | |
| Carpet on foam | 0.08 | 0.24 | 0.57 | 0.69 | 0.71 | 0.73 |
| Wall Materials | | | | | | |
| Brick: unglazed | 0.03 | 0.03 | 0.03 | 0.04 | 0.05 | 0.07 |
| Curtain: 10 oz./sq. yd. | 0.03 | 0.04 | 0.11 | 0.17 | 0.24 | 0.35 |
| Fiberglass: 2" | 0.17 | 0.55 | 0.80 | 0.90 | 0.85 | 0.80 |
| Glass: ¼" plate large | 0.18 | 0.06 | 0.04 | 0.03 | 0.02 | 0.02 |
| Polycarbonate | 0.27 | 0.38 | 0.25 | 0.18 | 0.1 | 0.07 |

-continued

| | 125 Hz | 250 Hz | 500 Hz | 1 kHz | 2 kHz | 4 kHz |
|---|---|---|---|---|---|---|
| Ceiling Materials | | | | | | |
| Acoustic ceiling tiles | 0.70 | 0.66 | 0.72 | 0.92 | 0.88 | 0.75 |
| ⅜" plywood panel | 0.28 | 0.22 | 0.17 | 0.09 | 0.10 | 0.11 |

Figure 3:
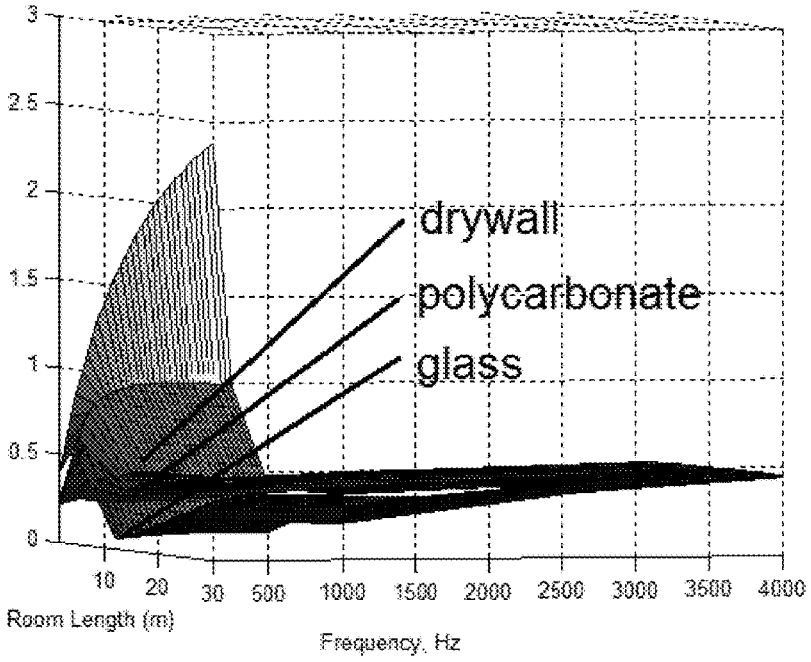
FIG. 3 represents the calculated $T_{60}$ in a room of variable dimensions with walls made out of three different materials, namely, glass, polycarbonate, and drywall.

FIG. 3 represents the calculated $T_{60}$ in a room of variable dimensions with walls made out of three different materials, namely, glass, polycarbonate, and drywall.

Figure 4A:
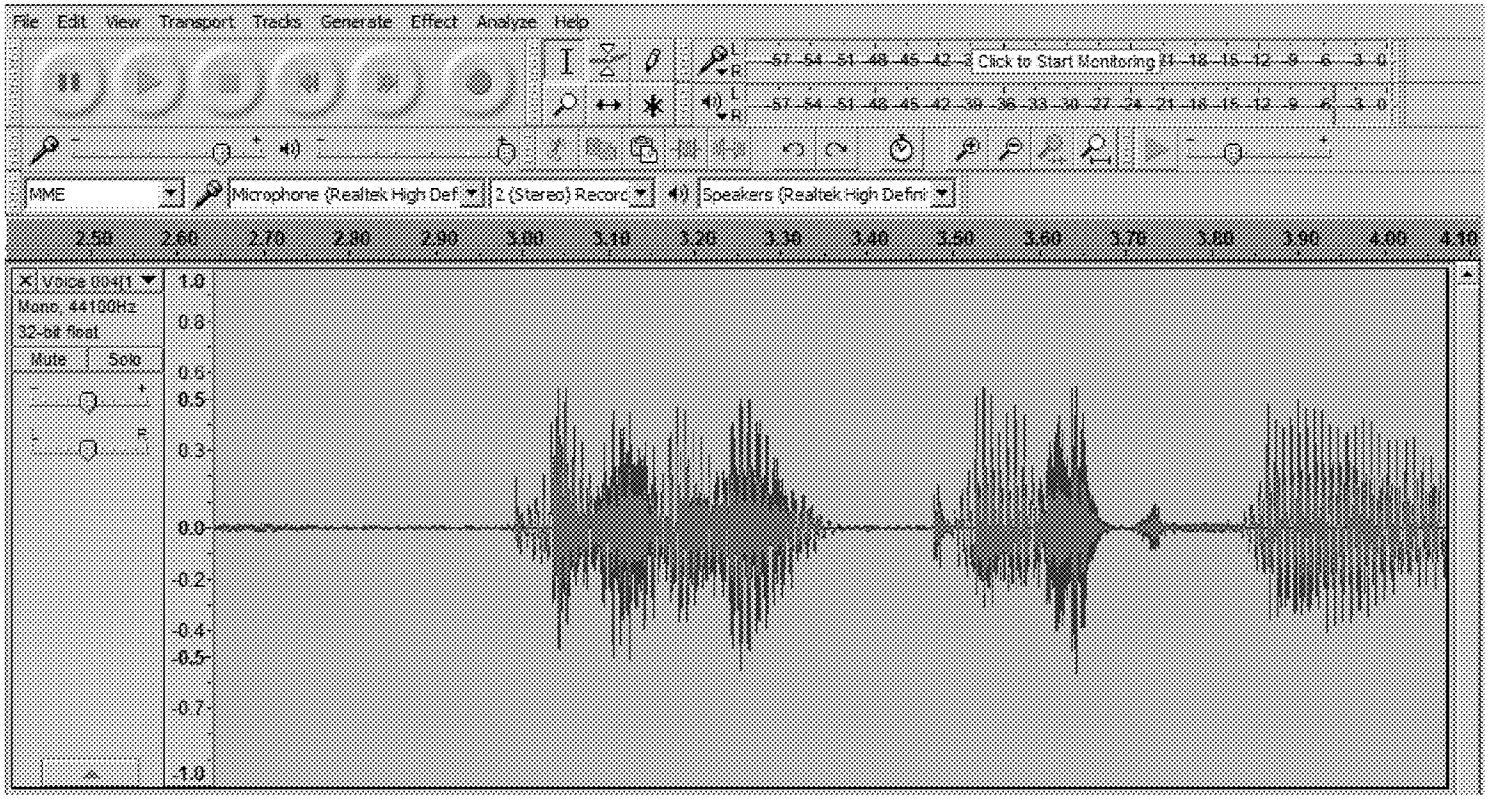
FIGS. 4A-4B provide an example of the effect that reverberation can have.
Figure 4B:
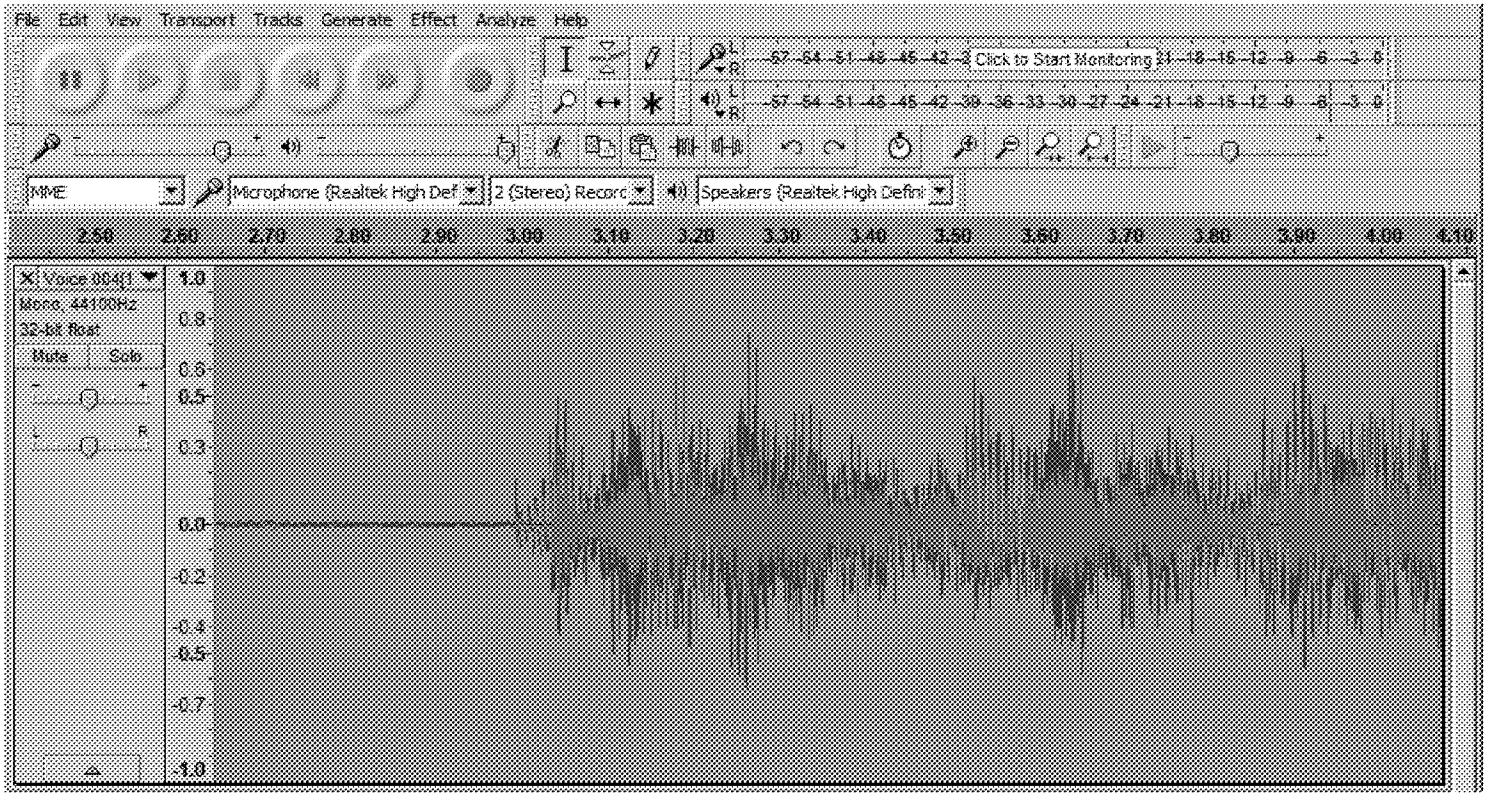

An example of the effect that reverberation can have is presented in FIGS. 4A-4B. FIG. 4A represents an original speech pattern, and FIG. 4B shows an example effect that reverberation can have. As can be seen from FIGS. 4A-4B, reverberation disrupts speech articulation by (among other things) filling in "spaces" between formants, which are clusters of vocal energy. Adding signal to these speech building blocks (namely, vowels and especially consonants) and disrupting the space between formants helps to make speech unintelligible and reduce the potentially adverse psychoacoustic effects of speech.

As indicated above, certain example embodiments may use active and/or passive approaches for triggering reverberation to serve in noise-cancelling roles. As will become clearer from the description below, active approaches may involve electronic, electromechanical, and/or selectively-controllable mechanical apparatus, to disrupt sound waves incident on a wall assembly or the like. Passive approaches may involve wall assemblies specifically engineered to trigger reverberation, e.g., through the incorporation of holes in the wall assemblies and/or the attachment or other formation of sound reverberating components therein and/or thereon, using natural properties of the thus-formed wall itself.

Figure 5:
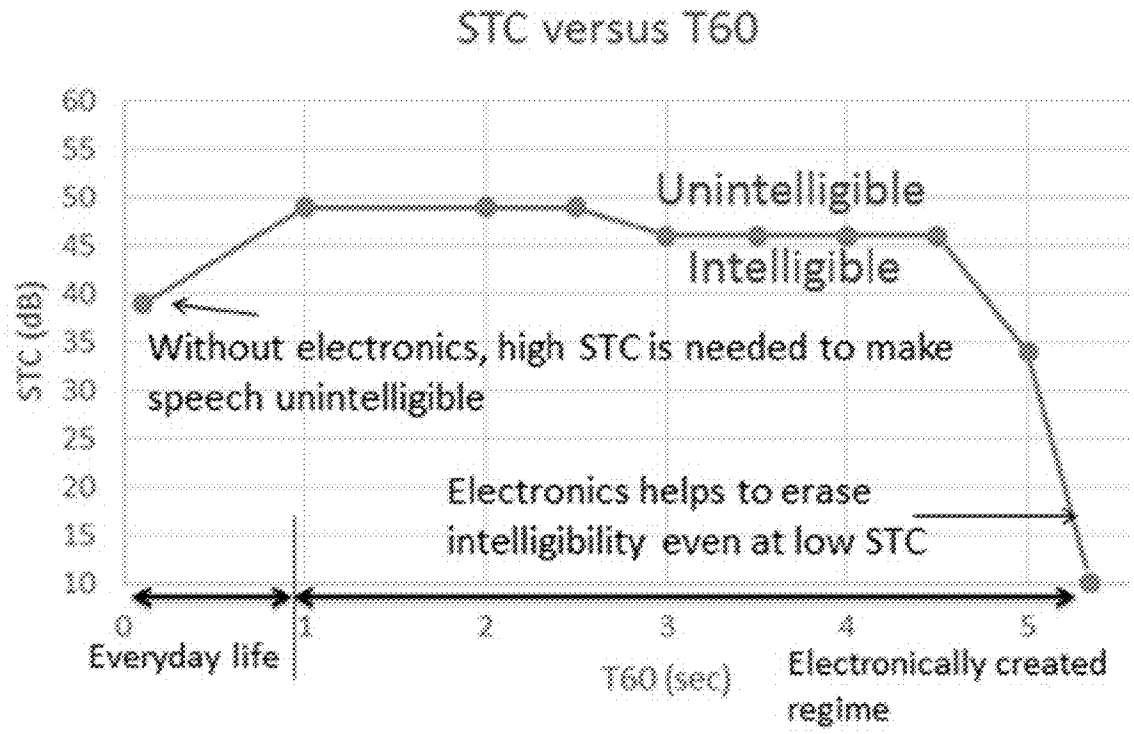
FIG. 5 a graph plotting STC vs. $T_{60}$, further confirming some advantages that result when using an active approach to sound masking, in accordance with certain example embodiments.

Referring once again to FIG. 3, it can be seen that reverberation in walls is primarily noticeable in the low-frequency range. Thus, it may be desirable to use an active approach in order to use reverberation in a high-frequency range to mask irritating sounds and speech. FIG. 5 is a graph plotting STC vs. T60, further confirming some advantages that result when using an active approach to sound masking, in accordance with certain example embodiments. That is, as can be seen in FIG. 5, a high STC can be desirable to make speech and/or the like unintelligible when dealing with a low T60 value. By contrast, an electronically-created regime can help to remove intelligibility even at low STC values.

Figure 6A:
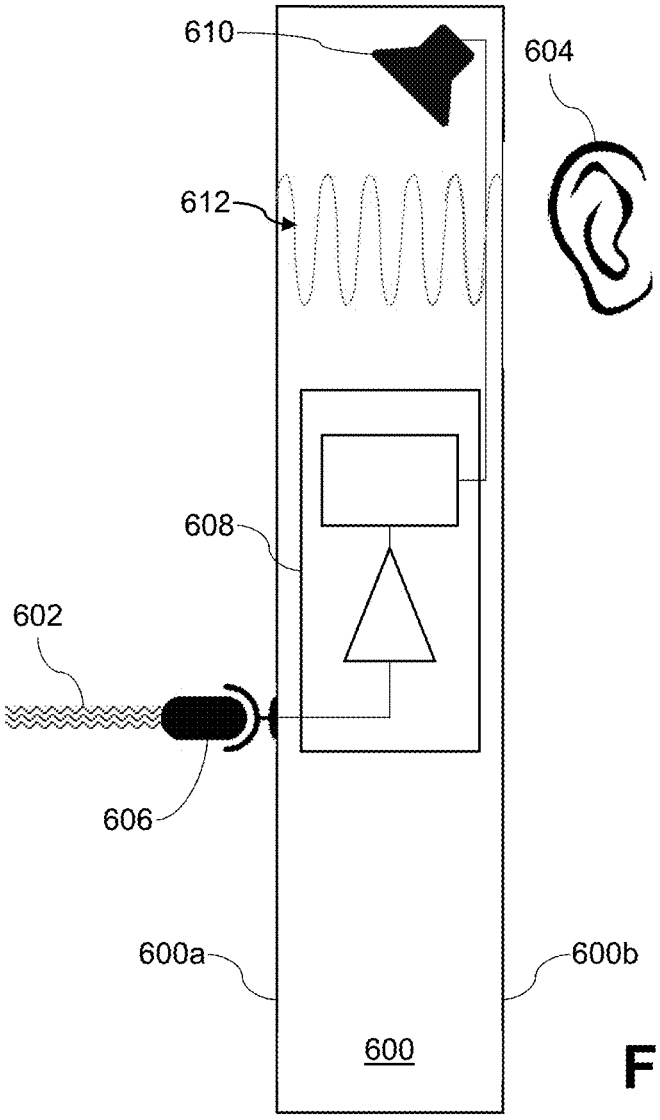
FIGS. 6A-6B are schematic views of acoustic wall assemblies incorporating active noise cancellation approaches in accordance with certain example embodiments.

FIG. 6A is a schematic view of an acoustic wall assembly that incorporates an active noise cancellation approach in accordance with certain example embodiments. As shown in FIG. 6A, a wall 600 includes outer and inner major surfaces 600*a* and 600*b*. It is desirable in the FIG. 6A embodiment to reduce the disruption and annoyance caused by the sound 602 relative to the listener(s) 604. Thus, a microphone or other listening device 606 picks up or otherwise receives this sound, and a signal is passed to the sound masking circuit 608 embedded in or otherwise provided in connection with the wall 600 in the broader wall assembly of FIG. 6A. The signal from the microphone 606 may be an analog or digital signal in different example embodiments, and the sound masking circuit 608 may include an analog-digital converter, e.g., in the event that an analog signal that is provided is to be processed digitally. In certain example embodiments, the microphone 606 may be installed within the wall 600.

The sound masking circuit 608 determines whether the signal that is provided to it from the microphone 606 is within one or more predetermined frequency ranges, and/or contains noise with the one or more predetermined frequency ranges therein. A bandpass or other filter that is a part of the sound masking circuit 608 may be used in this regard. One of the one or more predetermined frequency ranges may correspond to speech and/or noise determined to be psychoacoustically disruptive, disturbing, or annoying. One of the one or more predetermined frequency ranges may correspond to the 28-3200 Hz range, which helps to mask the sounds of most consonants (which may be the most statistically effective manner of masking sounds) and the sounds of at least some syllables.

Responsive to the detection of sound waves in the one or more predetermined frequency ranges, the sound masking circuit 608 actuates the air pump 610, e.g., to generate pressure waves to disrupt, via a reverberative and/or other effect, noise in a predetermined frequency range that otherwise would pass through the wall. The air pump 610 may be a speaker, part of an HVAC system, and/or the like. The air pump 610 creates reverberation 612 in the wall 600 between the outer and inner major surfaces 600*a* and 600*b*. This helps to actively mask the detected sound waves as they pass from outside the outside major surface 600*a* of the wall 600 to inside the inside major surface 600*b* of the wall 600, thereby helping to reduce annoyance caused to the listener(s) 604. That is, the reverberation 612 in certain example embodiments helps disrupt perceived speech and/or irritating noises. The reverberation 612 is substantially uniform throughout the entire wall 600 in certain example embodiments, as the air pump 610 in essence is not a point source of added noise. Thus, listeners basically will hear the same thing at any point beyond the wall 600, as noise in essence is concealed in the wall 600 in a non-constant, potentially "on demand" or dynamic manner. Advantageously, this effect helps guard against surveillance, as laser microphones (for example) cannot pickup discrete sounds, reverberation is self-referencing and thus harder to decipher, there is no added white noise that can be subtracted, etc.

In addition to or in place of reverberation, certain example embodiments may implement active masking by means of reverse masking. The noise masking enabled by the sound masking circuit 608 may be performed in accordance with an algorithm (e.g., a reverberation algorithm) that uses a technique such as, for example, standard convolution, enhanced convolution, reverse reverberation, delay-controlled reverberation, and/or the like. The sound masking circuit 608 may process incoming noise 602 and control the air pump 610 in accordance with output from the algorithm, in certain example embodiments. In certain example embodiments, the algorithm may change the perceived loudness of incident noise in the time domain.

The wall 600 may be formed from any suitable material such as, for example, one or more sheets of drywall, glass, polycarbonate, plaster, and/or the like. In certain example embodiments, the wall or material(s) comprising the wall has/have acoustic absorption coefficients ranging from: 0.03-0.3 at 125 Hz, 0.03-0.6 at 250 Hz, 0.03-0.6 Hz at 500 Hz; 0.03-0.9 at 1000 Hz, 0.02-0.9 at 2000 Hz, and 0.02-0.8 at 4000 Hz. In this regard, FIG. 6A may be thought of as being either a plan view or a cross-sectional view. In the case of the former (i.e., a plan view), the air pump 610 and/or sound masking circuit 608 may be provided above the wall 600 (e.g., in the ceiling and below, for example, an upper slab) or to the side of the wall 600. In certain example embodiments, the sound masking circuit 608 may be connected to a side of the wall 600 but concealed from view (e.g., by being hidden in the ceiling, behind molding, etc.). The same may be true for the microphone 606. The air pump 610 may force air onto the top and/or sides of the wall 600, triggering reverberation therein or thereof.

With respect to a cross-sectional view, the outer and inner major surfaces 600*a* and 600*b* may be separate drywall surfaces separated, for example, by metal and/or wooden studs, or the like. The air pump 610 and/or sound masking circuit 608 may be provided above the wall 600 (e.g., in the ceiling and below, for example, an upper slab), to the side of the wall 600, or within the gap between the outer and inner major surfaces 600*a* and 600*b*. Similar to the above, the sound masking circuit 608 may be connected to a side of the wall 600 but concealed from view (e.g., by being hidden in the ceiling, behind molding, within the gap between the outer and inner major surfaces 600*a* and 600*b*, etc.). The same may be true for the microphone 606. The air pump 610 may force air onto the top and/or sides of the wall 600, and/or within the gap between the outer and inner major surfaces 600*a* and 600*b* of the wall 600. Thus, in certain example embodiments, the wall 600 may be said to comprise first and second substantially parallel spaced apart substrates (of or including glass and/or the like), with the air pump 610 and the sound masking circuit 608 being located therebetween.

As alluded to above, the wall may be of or include glass. That is, certain example embodiments may be directed to a glass wall used in connection with an acoustic wall assembly. The glass wall may comprise, one, two, three, or another number of sheets of glass. The glass may be regular float, heat-strengthened, tempered, and/or laminated glass. In certain example embodiments, the wall may be of or include an insulated glass (IG) unit, a vacuum insulated glass (VIG) unit, and/or the like. An IG unit may include first and second substantially parallel spaced apart substrates, with an edge seal formed around peripheral edges, and with the cavity between the substrates optionally being filled with an inert gas (e.g., Ar, Xe, and/or the like) with or without air. A VIG unit may include first and second substantially parallel spaced apart substrates, with an edge seal formed around peripheral edges, and spacers, with the cavity between the substrates being evacuated to a pressure less than atmospheric. Framing may be provided around the IG unit and/or the VIG unit in some instances, and that framing may be a part of the acoustic wall assembly. In certain example embodiments, other transparent materials may be used. In certain example embodiments, the naturally high sound-reflection coefficient of glass may be advantageous, e.g., when triggering reverberation and/or other noise masking effects.

Figure 6B:
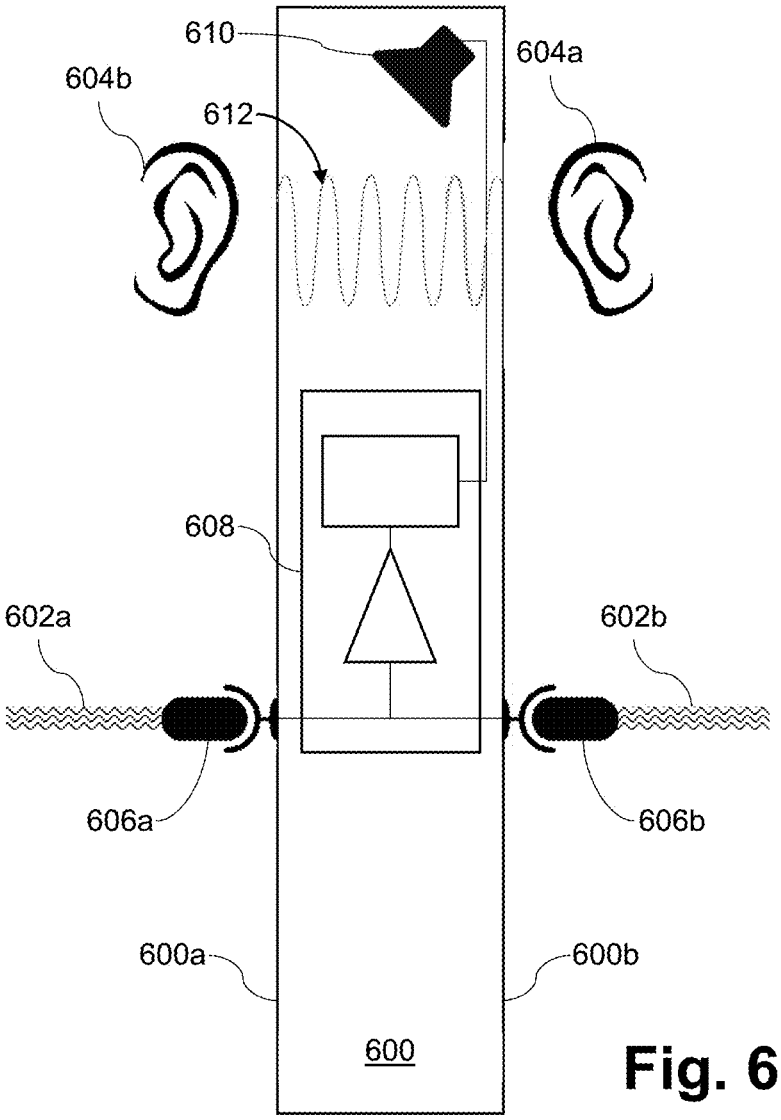

FIG. 6B is similar to FIG. 6A, except that first and second microphones 606*a* and 606*b* are provided so that incident noise 602*a* and 602*b* can be registered and compensated for, thereby reducing annoyance to listeners 604*a* and 604*b*, on both sides of the wall 600. In certain example embodiments, the same air pump 610 can be used to generate reverberation 612. In certain example embodiments, the sound masking circuit 608 may trigger the same or different actions with respect to the air pump 610, e.g., based on which side of the wall 600 the noise comes from. In this regard, the sound masking circuit 608 may be able to determine which side of the wall 600 the sound is coming from, e.g., based on intensity and/or the like. The effectiveness of the reverberation 612 may be picked up by the other microphone and fed back into the sound masking circuit 608, e.g., to improve the noise cancelling effects. In different embodiments, one or both of the first and second microphones 606*a* and 606*b* may be provided on inner or outer surfaces of the wall 600. In certain example embodiments, one of the first and second microphones 606*a* and 606*b* may be formed on an outer surface of the wall 600, and the other of the first and second microphones 606*a* and 606*b* may be formed on an inner surface of the wall 600. In the FIG. 6B example, reverberation may be said to work actively "in both directions" (although it will be appreciated that it may be possible to realize the same or similar functionality in connection with a single microphone in some cases).

Figure 7:
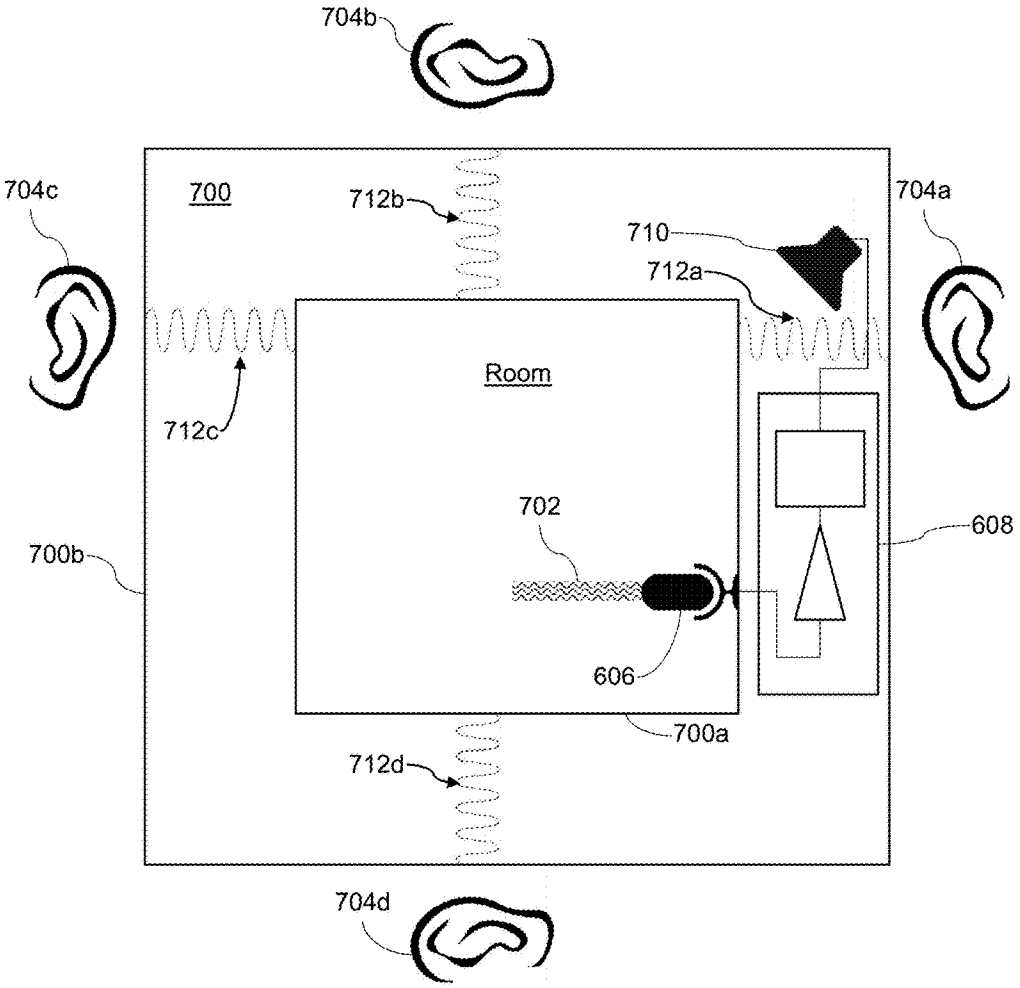
FIG. 7 is another schematic view of an acoustic wall assembly incorporating an active noise cancellation approach in accordance with certain example embodiments.

FIG. 7 is another schematic view of an acoustic wall assembly incorporating an active noise cancellation approach in accordance with certain example embodiments. FIG. 7 shows a wall 700 formed outside of a "quiet" or "secure" room. Noise 702 from inside the room is detected by microphone 606. The sound masking circuit 608 receives signals from the microphone 606 and triggers the air pump 710, which triggers reverberation 712*a*-712*d* in the wall 700. The reverberation 712*a*-712*d* is substantially uniform throughout the entire wall 700 in certain example embodiments, so that listeners 704*a*-704*d* around the room (and around the wall 700) cannot perceive sounds and/or annoyance from within. It will be appreciated that the FIG. 7 example may be modified so as to include one or more microphones inside of the room in certain example embodiments. Additionally, or in the alternative, it will be appreciated that the FIG. 7 example may be modified so as to include one or more microphones so as to detect and compensate for sounds originating from outside of the room, e.g., in a manner similar to that described in connection with FIG. 6B. One or more microphones provided to receive sounds originating from outside of the room, regardless of their placement, may be useful in turning FIG. 7 into a private or quiet room, where sounds from the outside are compensated for and masked.

Figure 8A:
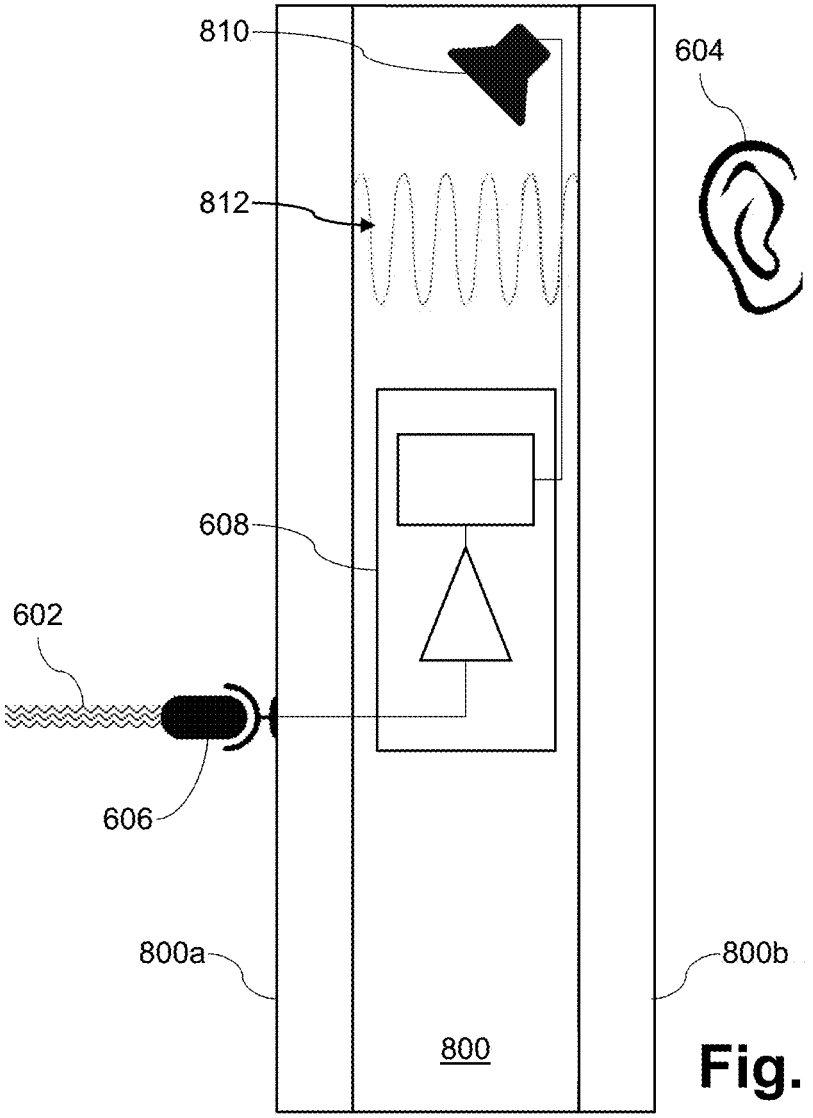
FIGS. 8A-8B are schematic views of acoustic wall assemblies incorporating active noise cancellation approaches usable in connection with two walls, in accordance with certain example embodiments.
Figure 8B:
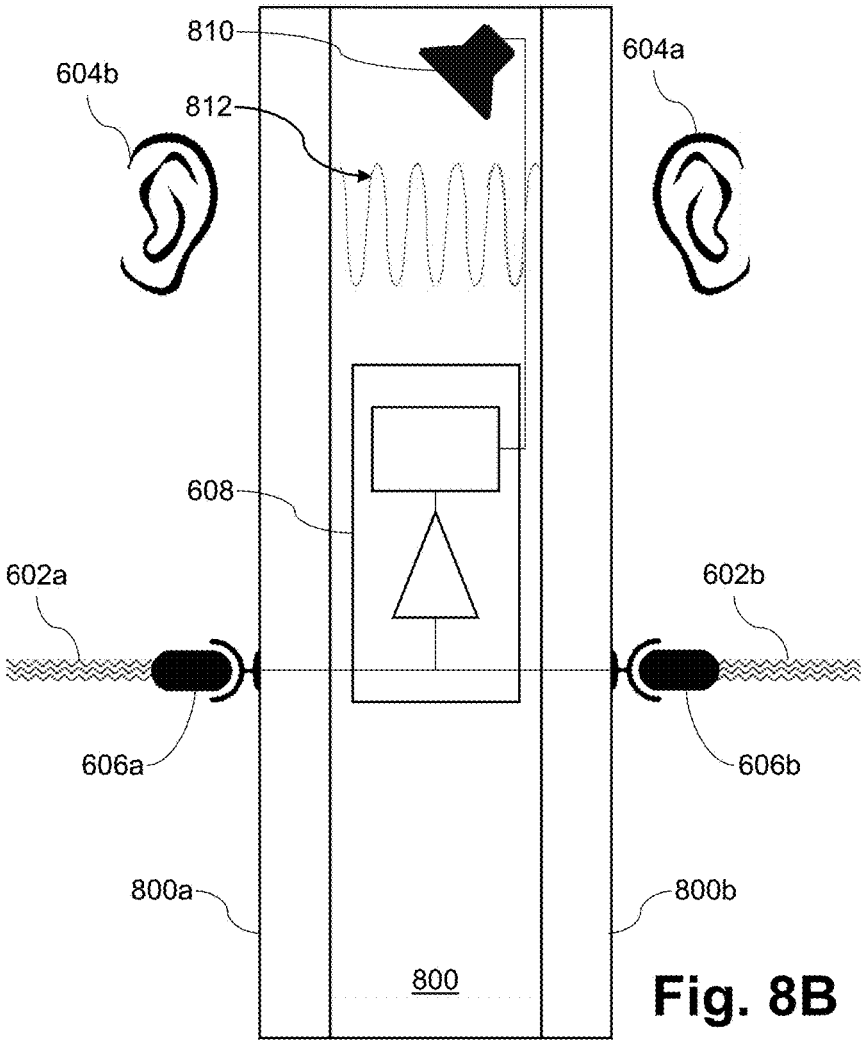

FIGS. 8A-8B are schematic views of acoustic wall assemblies incorporating active noise cancellation approaches usable in connection with two walls, in accordance with certain example embodiments. FIGS. 8A-8B are similar to FIGS. 6A-6B. However, rather than having outer and inner surfaces of a single wall, outer and inner walls 800*a* and 800*b* are provided. The noise masking circuit 608 and/or the pump 610 may be placed within the cavity 800 defined by the outer and inner walls 800*a* and 800*b*, and they may cooperate to create reverberation 812 in the cavity 800.

It is believed that a wall's lateral dimensions may mostly affect the fundamental spectral regions of speech and their lower harmonics, while the distance between the two sheets of a wall primarily will affect high-frequency components and their higher harmonics. An example embodiment of a glass wall has dimensions 10 ft.×12 ft., with air spacing between two sheets of glass preferably in the range of 1-20 cm, more preferably in the range of 7-17 cm, and an example separation of 10 cm.

Figure 9:
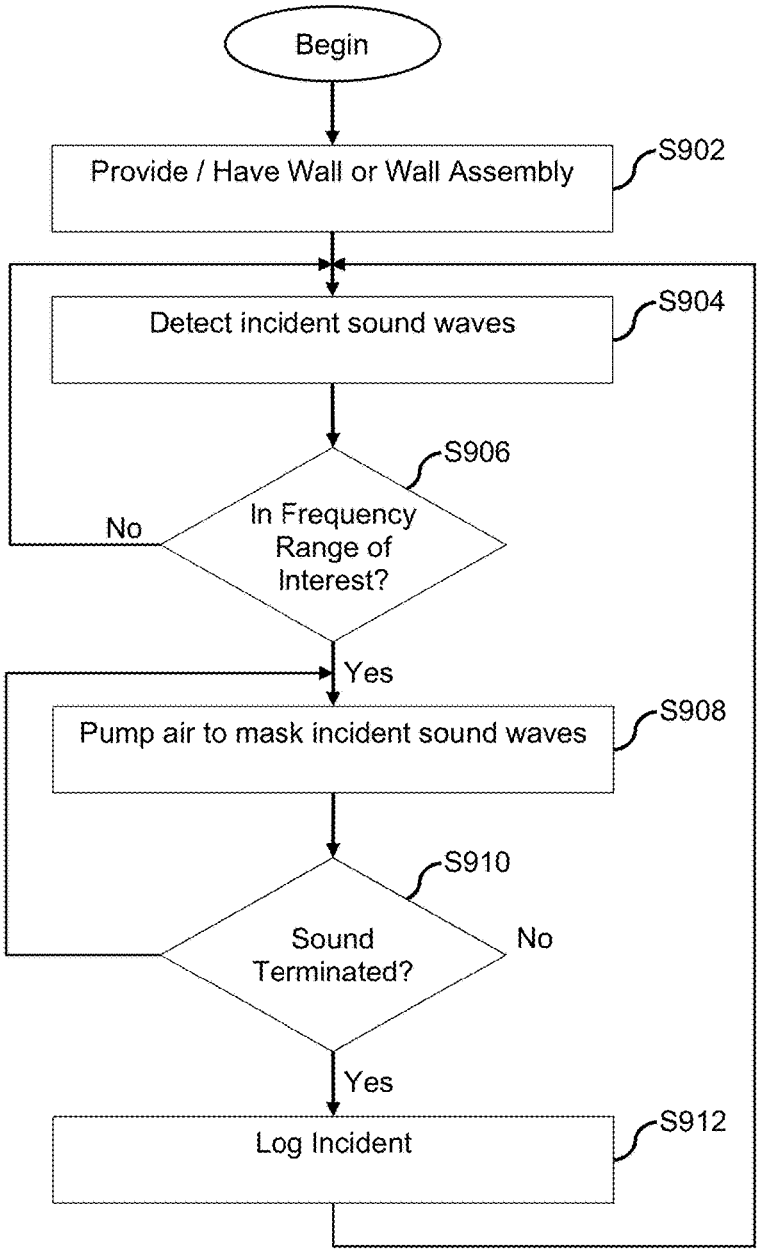
FIG. 9 is a flowchart showing an example approach for active noise cancellation, which may be used in connection with certain example embodiments.

FIG. 9 is a flowchart showing an example approach for active noise cancellation, which may be used in connection with certain example embodiments. FIG. 9 assumes that a wall or wall assembly is already provided (step S902). Incident sound waves are detected (step S904). If the detected sound waves are not in or do not include a frequency range of interest (as determined in step S906), then the process simply returns to step S904 and waits for further incident sound waves to be detected. On the other hand, if the detected sound waves are in or include a frequency range of interest (as determined in step S906), air is pumped to mask the incident sound waves (step S908). This behavior thus provides for dynamic or "on-demand" masking of noises, e.g., through a system that is not always on. If the sound is not terminated (as determined in step S910), then the process returns to step S908 and further air is pumped. On the other hand, if the sound is terminated, then information about the incident may be logged (step S912), and the process may return to step S904 and wait for further incident sound waves to be detected.

The logging of step S912 may include, for example, creation of a record in a data file stored to a non-transitory computer readable storage medium and/or the like (e.g., a flash memory, a USB drive, RAM, etc.). The record may include a timestamp indicating the start and stop times of the event, as well as a location identifier (e.g., specifying the wall at which the sound was detected for instance in the event that there are multiple walls implementing the technology disclosed herein, the microphone that detected the sound for instance in the event that there are multiple microphones in a given wall, etc.). Information about the frequency range(s) detected may be stored to the record, as well. In certain example embodiments, circuitry may store a digital or other representation of the detected sound, e.g., in the record or in an associated data file. As a result, speech or other noises may be recorded, potentially with entire conversations being captured and archived for potential subsequent analysis. For example, the sound masking circuit (for example) may be used as a recording device (e.g., like a security camera, eavesdropping device, sound statistics monitoring device, and/or the like). In certain example embodiments, information may be stored locally and transmitted to a remote computer terminal or the like for potential follow-up action such as, for example, playback of noise events and/or conversations, analysis of same (e.g., to help reveal what types of noises were recorded most, what time of day is the noisiest, who makes the most kinds of different noises, etc.). Transmission may be accomplished by removing physical media (such as a flash drive, USB drive, and/or the like), through a wired connection (e.g., including transmissions over a serial, USB, or other cable), wirelessly (e.g., by Wi-Fi, Bluetooth, over the Internet, and/or other like), etc. Information may be transmitted periodically and/or on-demand in different example embodiments.

In certain example embodiments, the sound masking circuit may be programmed to determine whether incident noise corresponds to a known pattern or type. For example, although annoying, alarm sounds, sirens, and/or the like, may be detected by the sound masking circuit and allowed to go through the wall assembly for safety, informational, and/or other purposes.

In certain example embodiments, the sound masking circuit may be programmed to operate as both a sound disrupter (e.g., through the use of reverberation and/or the like), as well as a sound sweetener. With respect to the latter, the sound masking circuit may generate reverberative and/or pleasant sounds to help mask potentially annoying noises. Pleasant sounds may be nature sounds (e.g., the sound of the ocean), sounds of animals (e.g., dolphins), soothing music, and/or the like. These sounds may be stored to a data store accessible by the sound masking circuit. When appropriate (e.g., when triggering reverberation as described above), the sound masking circuit may retrieve the sound sweetener and provide it as output to a speaker or the like (which may be, for example, the same or different speaker as is used as the air pump in certain example embodiments).

Another example embodiment uses a more passive approach to an acoustic wall assembly. For example, a passive approach may use the wall itself as a reverberation-inducing resonator that involves acoustic contrast. This may be accomplished by having one or more (and preferably two or more) openings, slits, and/or the like, formed in the acoustic wall assembly, thereby using natural properties of the wall itself to create reverberative effects of a desired type. These features may be formed on one side of the acoustic wall assembly, adding to the acoustics of the wall assembly directional properties. For example, at least one opening may be made in the outside pane of a double-pane wall in order to make the effect directional, and so that the effect of reverberation is more pronounced outside of the wall. As another example, at least one opening may be made in the inside pane of the double-pane wall. This may be advantageous for some applications, like music halls, which may benefit from additional sound reverberation that makes sounds seem richer.

In certain example embodiments, additional reverberating elements may be affixed to a wall. The sound-masking reverberation-inducing element(s) may be provided in a direct contact with a single or partial wall, so the wall can act as a sound source in certain example embodiments. In certain example embodiments, the sound-masking reverberation-inducing element(s) may be provided between the walls in a wall assembly. Sound masking advantageously results in an increased noise/signal contrast, which makes speech perceived behind a single or partial wall less comprehensible and irritating sounds less annoying.

In certain example embodiments, a first set of features may be formed in and/or on an inner pane and a second set of features may be formed in and/or on an outer pane, e.g., keeping some annoying or disruptive sounds out and improving the acoustics "on the inside." In certain example embodiments, multiple sets of features may be formed in and/or on one or both panes of a two-pane wall assembly, with each set of features targeting a different range to be eliminated and/or emphasized.

Other natural properties of the wall assembly (including size, space between adjacent upright walls, etc.) also may be selected to trigger desirable reverberative effects, e.g., as described above.

Figure 10:
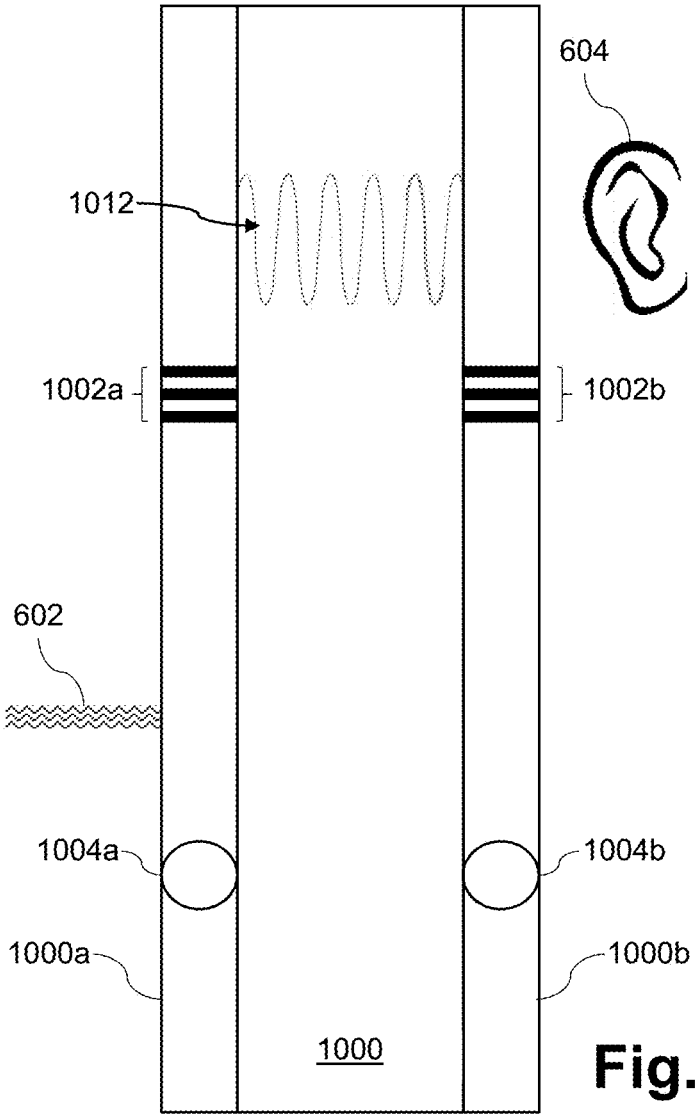
FIG. 10 is a schematic view of an acoustic wall assembly incorporating a passive noise cancellation approach in accordance with certain example embodiments.

It will be appreciated that these more passive techniques may be used in addition to the active techniques discussed above, e.g., with single- or two-wall acoustic wall assemblies. It also will be appreciated that these more passive techniques may be used by themselves. In this latter regard, FIG. 10 is a schematic view of an acoustic wall assembly 1000 incorporating a passive noise cancellation approach in accordance with certain example embodiments.

The acoustic wall assembly 1000 includes outer and inner walls 1000*a* and 1000*b*, which define a gap or cavity therebetween. Noise 602 is incident on the outer wall 1000, and a series of features formed in the wall set up reverberation 1012. As shown in the FIG. 10 example, these features include first and second sets of slits 1002*a* and 1002*b* and first and second holes 1004*a* and 1004*b*. The sets of slits 1002*a*-1002*b* and the holes 1004*a*-1004*b* are designed to address different frequency ranges of the noise 602 and contribute the reverberation 1012 in different ways. Although not shown in FIG. 10, additional features may be affixed to the walls 1002*a*-1002*b* to cause it to resonate in a manner that creates the desired reverberation.

The wall assembly 1002 thus is made in the manner of a sound resonator with specifically designed fundamental resonant frequencies. As above, any suitable material may be used in constructing the walls 1002*a*-1002*b*. For example, because glass is a naturally good resonator, certain example embodiments are able to make use of a variety of resonant harmonics, which are the integer multiples of the fundamental frequency. Regardless of the material, tailoring of the incoming sound via the features may help to disrupt the frequency ranges of the speech and noise in order to make it unintelligible and/or less annoying. For example, it is possible to target those frequency ranges associated with consonants when dealing with speech, etc. Moreover, because such a wall assembly is designed for selective sound disruption, it is possible in certain example embodiments to use thin glass and longer-lasting rigid joints in the wall assembly. This construction advantageously may make the entire design more solid and reliable. When glass is used, high tolerances may be desirable in order to help maximize the effectiveness of sound resonating properties by avoiding leakage, etc.

The walls described herein may be partial walls, e.g., walls that leave open space between separated areas.

Methods of making the above-described and/or other walls and wall assemblies are also contemplated herein. For the example active approaches described herein, such methods may include, for example, erecting walls, connecting microphones and air pumps to sound masking circuits, etc. Configuration steps for sound masking circuits (e.g., specifying one or more frequency ranges of interest, when/how to actuate an air pump, etc.) also are contemplated. Mounting operations may be used, e.g., with respect to the microphone and/or the air pump (including the hanging of speakers), etc. Integration with HVAC systems and/or the like also is contemplated. For the example passive approaches described herein, such methods may include, for example, erecting walls, and forming reverberation-inducing elements therein and/or affixing reverberation-inducing elements thereto.

In a similar vein, methods of retrofitting existing walls and/or wall assemblies also are contemplated and may include the same or similar steps. Retrofit kits also are contemplated herein.

Certain example embodiments have been described in connection with acoustic walls and acoustic wall assemblies. It will be appreciated that these acoustic walls and acoustic wall assemblies may be used in a variety of applications to alter perceived speech patterns, obscure certain irritating sound components emanated from adjacent areas, and/or the like. Example applications include, for example, acoustic walls and acoustic wall assemblies for rooms in a house; rooms in an office; defined waiting areas at doctors' offices, airports, convenience stores, malls, etc.; exterior acoustic walls and acoustic wall assemblies for homes, offices, and/or other structures; outer elements (e.g., doors, sunroofs, or the like) for vehicles; etc. Sound masking may be provided for noises emanating from an adjacent area, regardless of whether that adjacent area is another room, outside of the confines of the structure housing the acoustic wall and acoustic wall assembly, etc. Similarly, sound masking may be provided to prevent noises from entering into an adjacent area of this or other sort.

The acoustic walls and acoustic wall assemblies may be full-height or partial-height in different instances.

In certain example embodiments, an acoustic wall assembly is provided. A wall has an outside major surface and an inside major surface. An air pump is provided. A sound masking circuit is configured to: detect sound waves in a predetermined frequency range; and responsive to detection of sound waves in the predetermined frequency range, control the air pump to pump air to actively mask the detected sound waves as they pass from outside the outside major surface of the wall to inside the inside major surface of the wall.

In addition to the features of the previous paragraph, in certain example embodiments, the wall may be a glass wall.

In addition to the features of either of the two previous paragraphs, in certain example embodiments, the air pump may be embedded in the wall and may be arranged to pump air therein.

In addition to the features of any of the three previous paragraphs, in certain example embodiments, the air pump may be a speaker.

In addition to the features of any of the four previous paragraphs, in certain example embodiments, a microphone embedded may be in the wall.

In addition to the features of any of the five previous paragraphs, in certain example embodiments, active acoustic masking may be performed using reverse masking.

In addition to the features of any of the six previous paragraphs, in certain example embodiments, active masking may be performed using reverberation.

In addition to the features of any of the seven previous paragraphs, in certain example embodiments, the sound masking circuit may comprise a controller configured to (a) process detected sound waves in the predetermined frequency range in accordance with an algorithm and (b) control the air pump to pump air to actively mask the detected sound waves in accordance with output from the algorithm.

In addition to the features of the previous paragraph, in certain example embodiments, the algorithm may be a reverberation algorithm selected from the group consisting of: standard convolution, enhanced convolution, reverse reverberation, and delay-controlled reverberation.

In addition to the features of any of the nine previous paragraphs, in certain example embodiments, the predetermined frequency range may correspond to speech and/or noise determined to be psychoacoustically disruptive, disturbing, or annoying.

In addition to the features of any of the 10 previous paragraphs, in certain example embodiments, a first microphone may be embedded in the wall and a second microphone may be installed on the outside major surface of the wall.

In addition to the features of the previous paragraph, in certain example embodiments, the sound masking circuit may be further configured to: control the air pump to pump air to actively mask detected sound waves as they pass from outside the outside major surface of the wall to inside the inside major surface of the wall, in response to detection of the sound waves via the first microphone, and control the air pump to pump air to actively mask detected sound waves as they pass to outside the outside major surface of the wall from inside the inside major surface of the wall, in response to detection of the sound waves via the second microphone.

In addition to the features of either of the two previous paragraphs, in certain example embodiments, active masking may be performed using reverberation.

In addition to the features of any of the 13 previous paragraphs, in certain example embodiments, at least one opening may be formed in the wall, e.g., with the at least one opening causing generated reverberation to be directional relative to the outside and inside major surfaces of the wall.

In addition to the features of any of the 14 previous paragraphs, in certain example embodiments, at least one opening formed in the wall may be formed in the wall, e.g., with the at least one opening having a size, shape, and dimension selected to trigger reverberation at a desired frequency range.

In addition to the features of any of the 15 previous paragraphs, in certain example embodiments, the wall may have acoustic absorption coefficients ranging from: 0.03-0.3 at 125 Hz, 0.03-0.6 at 250 Hz, 0.03-0.6 Hz at 500 Hz; 0.03-0.9 at 1000 Hz, 0.02-0.9 at 2000 Hz, and 0.02-0.8 at 4000 Hz.

In certain example embodiments, an acoustic wall assembly is provided. A wall has an outside major surface and an inside major surface. A receiver is sensitive to sound. A pump is controllable to generate pressure waves. A control circuit is operably coupled to the receiver and the pump, with the control circuit being configured to process a signal received from the receiver and control the pump to selectively generate pressure waves to disrupt, via a reverberative effect, noise in a predetermined frequency range that otherwise would pass through the wall.

In certain example embodiments, a kit for retrofitting a wall to provide an acoustic wall assembly with noise masking properties is provided. The kit comprises a receiver sensitive to sound; a pump controllable to generate pressure waves in and/or on the acoustic wall assembly; and a control circuit operably connectable to the receiver and the pump, with the control circuit being configured to process a signal received from the receiver and control the pump to selectively generate pressure waves to disrupt, via a reverberative effect, noise in a predetermined frequency range that otherwise would pass through the wall.

In certain example embodiments, a method of disrupting noise is provided. A wall includes an outside major surface and an inside major surface. Sound waves in a predetermined frequency range are detected via a sound masking circuit. Responsive to detection of sound waves in the predetermined frequency range, an air pump is controlled via the sound masking circuit to pump air in and/or around the wall to actively mask the detected sound waves as they pass from outside the outside major surface of the wall to inside the inside major surface of the wall.

In addition to the features of the previous paragraph, in certain example embodiments, the air pump and/or the sound masking circuit may be embedded in the wall.

In addition to the features of either of the two previous paragraphs, in certain example embodiments, active acoustic masking may be performed using reverse masking.

In addition to the features of any of the three previous paragraphs, in certain example embodiments, active masking may be performed using reverberation.

In addition to the features of any of the four previous paragraphs, in certain example embodiments, the sound masking circuit may comprise a controller configured to (a) process detected sound waves in the predetermined frequency range in accordance with an algorithm and (b) control the air pump to pump air to actively mask the detected sound waves in accordance with output from the algorithm.

In addition to the features of any of the five previous paragraphs, in certain example embodiments, a first microphone may be embedded in the wall and a second microphone may be installed on the outside major surface of the wall.

In addition to the features of the previous paragraph, in certain example embodiments, the sound masking circuit may be further configured to: control the air pump to pump air to actively mask detected sound waves as they pass from outside the outside major surface of the wall to inside the inside major surface of the wall, in response to detection of the sound waves via the first microphone, and control the air pump to pump air to actively mask detected sound waves as they pass to outside the outside major surface of the wall from inside the inside major surface of the wall, in response to detection of the sound waves via the second microphone.

In certain example embodiments, a method of making a sound-masking wall assembly that includes a wall is provided. A receiver sensitive to sound is provided. A pump controllable to generate pressure waves for the sound-masking wall assembly is provided. A control circuit is operably coupled to the receiver and the pump, with the control circuit being configured to process a signal received from the receiver and control the pump to selectively generate pressure waves to disrupt, via a reverberative effect, noise in a predetermined frequency range that otherwise would pass through the wall.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An acoustic wall assembly, comprising:

a wall having an outside major surface and an inside major surface;

an air pump;

a sound masking circuit configured to:

detect sound waves in a predetermined frequency range, and responsive to detection of sound waves in the predetermined frequency range, control the air pump to pump air to actively mask the detected sound waves as they pass from outside the outside major surface of the wall to inside the inside major surface of the wall; and at least one opening formed in the wall, the at least one opening having a size, shape, and dimension selected to trigger reverberation at a desired frequency range, wherein the reverberation is generatable to account for sound flanking and infra-sound beating.

2. An acoustic wall assembly, comprising:

a wall having an outside major surface and an inside major surface;

an air pump; and a sound masking circuit configured to:

detect sound waves in a predetermined frequency range, and responsive to detection of sound waves in the predetermined frequency range, control the air pump to pump air to actively mask the detected sound waves as they pass from outside the outside major surface of the wall to inside the inside major surface of the wall, wherein the air pump is embedded in the wall and is arranged to pump air therein, the air pump being controllable by the sound masking circuit to create a dynamic non-point source of reverberative noise that is concealed in, and substantially uniform throughout, the wall, wherein the reverberative noise is generated in an on-demand manner to disrupt intelligibility of the detected sound waves as they pass from outside the outside major surface of the wall to inside the inside major surface of the wall without substantial sound abatement of the detected sound waves, and wherein the wall has acoustic absorption coefficients ranging from: 0.03-0.3 at 125 Hz, 0.03-0.6 at 250 Hz, 0.03-0.6 Hz at 500 Hz; 0.03-0.9 at 1000 Hz, 0.02-0.9 at 2000 Hz, and 0.02-0.8 at 4000 Hz.

3. An acoustic wall assembly, comprising:

a wall having an outside major surface and an inside major surface;

a receiver sensitive to sound;

a pump controllable to generate pressure waves; and a control circuit operably coupled to the receiver and the pump, the control circuit being configured to process a signal received from the receiver and control the pump to dynamically generate pressure waves to disrupt, by making the wall itself reverberate in an on-demand manner, noise in a predetermined frequency range that otherwise would pass through the wall, wherein the pressure waves are generatable to respond to detected beating and/or to noise caused by sound flanking.

4. The acoustic wall assembly of claim 3, further comprising at least one opening formed in the wall, the at least one opening causing generated reverberation to be directional relative to the outside and inside major surfaces of the wall.

5. A kit for retrofitting a wall to provide an acoustic wall assembly with noise masking properties, the kit comprising:

a receiver sensitive to sound;

a pump controllable to generate pressure waves in and/or on the acoustic wall assembly; and a control circuit operably connectable to the receiver and the pump, the control circuit being configured to process a signal received from the receiver and control the pump to dynamically generate pressure waves to cause the wall itself to reverberate to disrupt noise in a predetermined frequency range that otherwise would pass through the wall, wherein the pressure waves are generatable to respond to detected beating and/or to noise caused by sound flanking.

6. A method of making a sound-masking wall assembly, the method comprising:

having a wall;

providing a receiver sensitive to sound;

providing a pump controllable to generate pressure waves for the sound-masking wall assembly; and operably coupling a control circuit to the receiver and the pump, the control circuit being configured to process a signal received from the receiver and control the pump to dynamically generate pressure waves to disrupt, via a reverberative effect, psychoacoustically disruptive noise in a predetermined frequency range that otherwise would pass through the wall, wherein the generated pressure waves are generated so as to disrupt, without substantially cancelling and without substantially completely covering over, the psychoacoustically disruptive noise, while also accounting for sound flanking and infra-sound beating.

* * * * *